US006502275B1

(12) United States Patent
Hsieh

(10) Patent No.: US 6,502,275 B1
(45) Date of Patent: Jan. 7, 2003

(54) ANTI-EXPLOSION STEAM VACUUM CLEANER HEATING STRUCTURE

(75) Inventor: Yung-Lung Hsieh, Hsin-Chuang (TW)

(73) Assignee: Ye Jen Co., Ltd, Hsin-Chuang (TW)

( * ) Notice: Subject to any disclaimer, the term of this patent is extended or adjusted under 35 U.S.C. 154(b) by 0 days.

(21) Appl. No.: 09/721,928

(22) Filed: Nov. 27, 2000

(51) Int. Cl.[7] ..... A47L 5/00
(52) U.S. Cl. ..... 15/320; 15/344
(58) Field of Search ..... 15/320, 344

(56) References Cited

U.S. PATENT DOCUMENTS 4,114,229 A * 9/1978 Jones et al. ..... 15/320
5,341,541 A * 8/1994 Sham ..... 15/320
5,819,364 A * 10/1998 Sham ..... 15/320
6,031,969 A * 2/2000 Burr et al. ..... 15/320
6,112,367 A * 9/2000 Burr et al. ..... 15/320
6,125,498 A * 10/2000 Roberts et al. ..... 15/320
6,438,793 B1 * 8/2002 Miner et al. ..... 15/320

* cited by examiner

*Primary Examiner*—Theresa T. Snider
(74) *Attorney, Agent, or Firm*—Troxell Law Office PLLC

(57) ABSTRACT

An improved anti-explosion steam vacuum cleaner heating structure, more especially an improved heating structure for the vacuum to provide the function of dirt removal and sterilization, which includes a water chamber and a tubular heat converter to directly heat the transferred clear water pressurized by a water pump to form the steam to be discharged through the discharge port via the free end of the conduit. The volume of the steam is controlled according to the volume of the water flow.

2 Claims, 3 Drawing Sheets

ANTI-EXPLOSION STEAM VACUUM CLEANER HEATING STRUCTURE

BACKGROUND OF THE INVENTION

1) Field of the Invention

The invention herein relates to an improved anti-explosion steam vacuum cleaner heating structure, more especially an improved heating structure for the vacuum to provide the function of dirt removal and sterilization, mainly comprises of a water chamber and a tubular heat converter to directly heat the transferred clear water pressurized by a water pump to form the steam to be discharged through the discharge port via the free end of the conduit, thus to synchronously control the volume of the steam according to the volume of the water current and to avoid the danger of explosion caused by the inner air pressure.

2) Description of the Prior Art

With the main objective of providing multi-functions even including disinfection and grease removal, the conventional vacuum cleaner mainly comprises a vacuum for drawing dust and an internal heating means for heating the cleaning water. The conventional heating means usually utilizes an electric resistance heating means to directly increase the temperature of the whole body of water inside the vacuum cleaner. When the whole body of water or the surface of the water reaches the critical point of evaporation, the steam will be discharged to the outside. However, under normal temperatures, it takes a long time to heat the whole body of water inside the water chamber then to convert it into the steam. Furthermore, the forming of the steam will also increase the inner pressure in the water chamber at the same time and the steam will be selectively discharged by the control valve. Therefore, during the process, the pressure formed inside the water chamber might cause the danger of explosion due to unstable power current or failure of the worn material of the water chamber to bear the high steam pressure.

Therefore, the inventor of the invention herein, based on the experience accumulated from the engagement in years in professional research, manufacture and the experience of marketing promotion, addressed the said shortcomings of the conventional steam vacuum cleaner through continuous experimental production and trail, culminated in the development of the improved anti-explosion steam vacuum cleaner heating structure of the invention herein.

SUMMARY OF THE INVENTION

Specially, the invention herein utilizes a tubular heat converter, through a water pump supplying a proper amount of water, to directly heat the water to form steam with an outward free end allowing the formed steam to be completely discharged to the outside of the body portion. During the process of evaporation, the water pump supplies a proper amount of water and selectively transfers a certain amount of water into the heat converter. Therefore, the heating structure of the invention herein will not cause the danger of increasing the inner pressure of the water chamber, but will produce the high volume of steam immediately.

To enable a further understanding of the said objectives, the technological methods and the efficiency of the invention herein, the brief description of the drawings below is followed by detailed description of the preferred embodiments.

DETAILED DESCRIPTION OF THE PREFERRED EMBODIMENT

Figure 1:
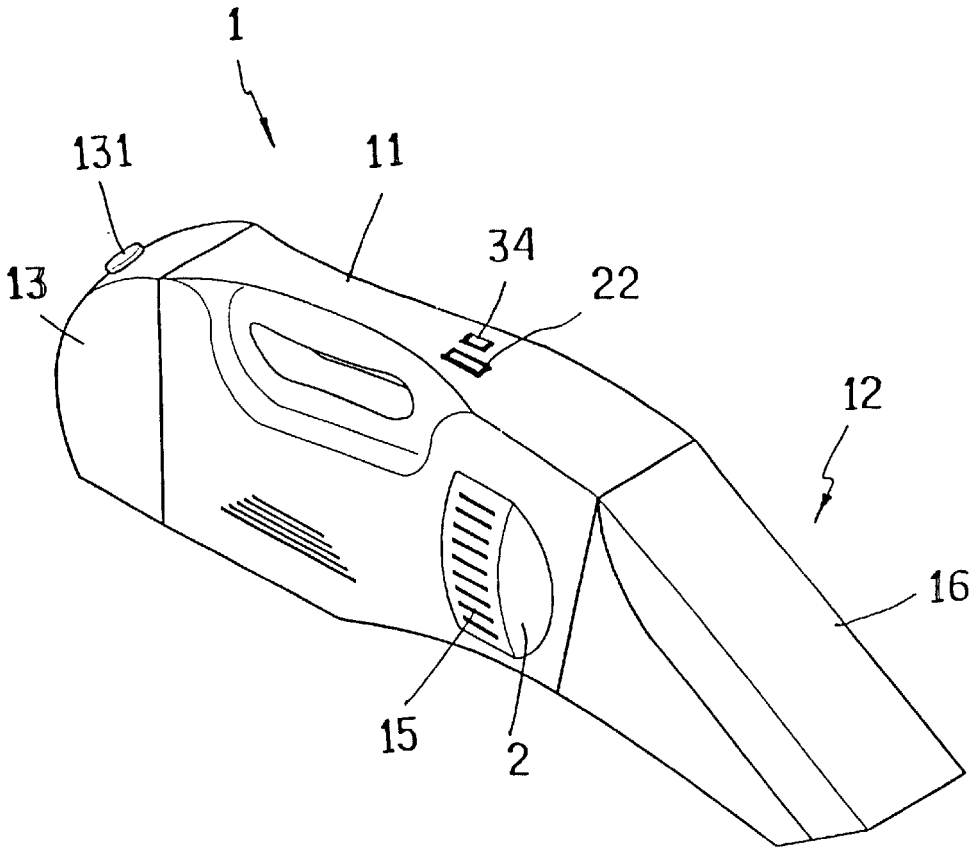
FIG. 1 is an isometric external drawing of the invention herein.

Referring to FIG. 1, the invention herein relates to an improved anti-explosion steam vacuum cleaner having structure, basically comprises a body portion (1) with a dust collecting chamber (12) mounted forward on the body portion (1) and a lifting handle (11) located at the rear end of the body portion (1), an on/off switch (22) for vacuuming mode and a steam activating switch (34) are positioned adjacent the lifting handle (11). A water chamber (13) with a water inlet (131) for receiving the water is disposed on the rear lateral side of the body portion (1), a vacuum pump (2) is located relative to the rear end of the dust collecting chamber (12), and an air pressure relief hole (15) is mounted relative to the vacuum pump (2) and the housing.

Figure 2:
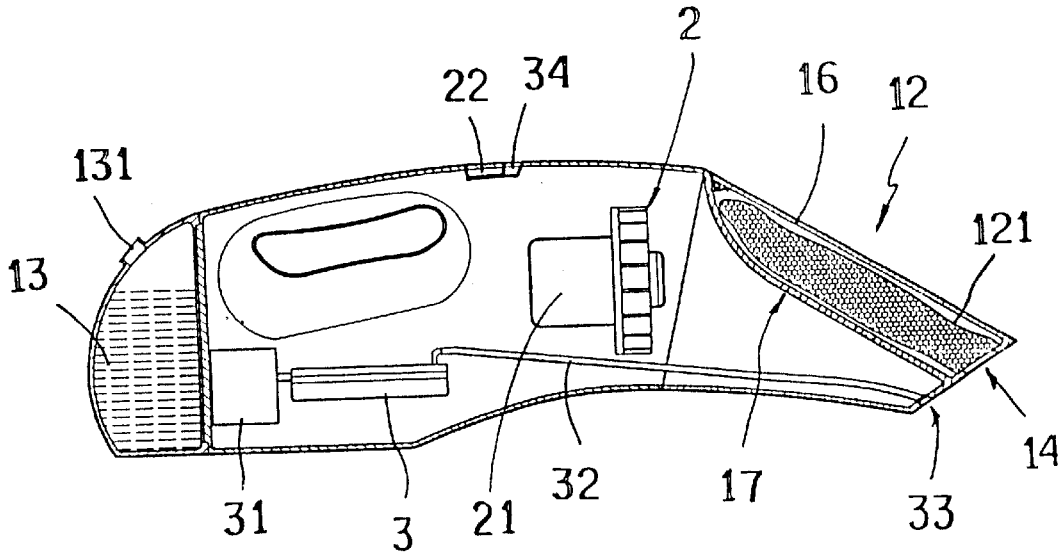
FIG. 2 is a lateral cutaway drawing of the structure of the invention herein.

Referring to FIG. 2, the detachable dust collecting chamber (12) mounted forward on the body portion (1) has a cover panel (16) and air ports (17) located at the end of the dust collecting chamber (12) relative to the vacuum pump (2). A suction port (14) is located at the front distal end of the body portion (1) for drawing the dust. A filter bag (121) can filter the air and conduct the pressure of the vacuum pump (2). A water chamber (13) is disposed on the rear lateral side of the body portion (1) for receiving cleaning water through the water inlet (131) and a water pump (31) is located between the water chamber (13) and the tubular heat converter (3). The electric control of the water pump (31) and the converter (3) is synchronously controlled by the steam activating switch (34). Of course, under a cold starting, the foregoing controlling process can be achieved by other selective ways to make a single preheat for the converter depending on the power ratio of the converter or the efficiency of the heating energy. However, the preheat method relates to the general circuit compositions which will not be discussed here. A steam conduit (32) conducts the steam to the steam discharge port (33) located at the front distal end of the body portion (1). Therefore, when the user wants access to the steam for cleaning the grease or sterilization, the switch (34) will transmit the power to the water pump (31) and the converter (3) to access the water from the water chamber (13) and allocate the water to the inside of the converter (3) for heating. The steam formed after the heating will be discharged through the steam discharge port (33) via the conduit (32). Therefore, the selection of the steam volume is depending on the water volume pumped by the water pump (31), to put in another way, the controlled water current through the water pump (31) decides how much volume of steam will be discharged. The water pump (31) transfers the water to the inside of the converter (3) to gain the heat directly to evaporate and form the steam which will be conducted out via the conduit (32). The heat converter (3) with high power ratio can instantly heat and convert the clear water into steam. Therefore, in terms of the integral heating structure, the invention herein will not cause the danger of air explosion inside the water chamber as the conventional structure will, since the latter directly heats the water body in the water chamber as a whole.

Figure 4:
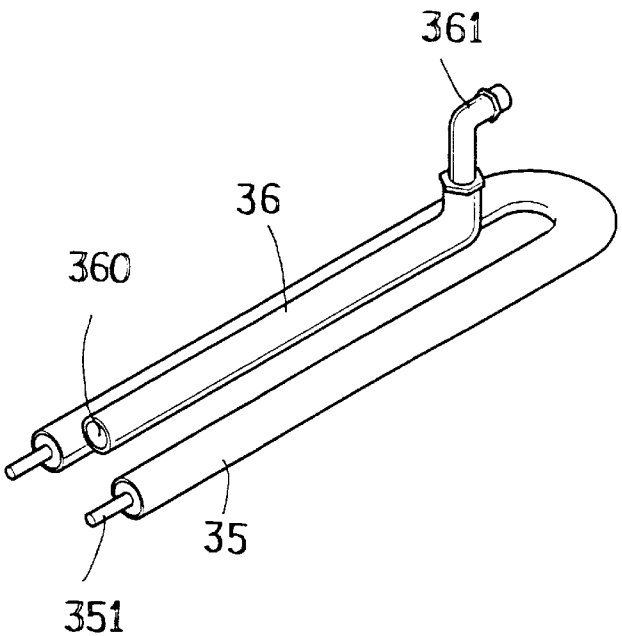
FIG. 4 is an isometric drawing of the basic structure of the heating means of the invention herein.
Figure 3:
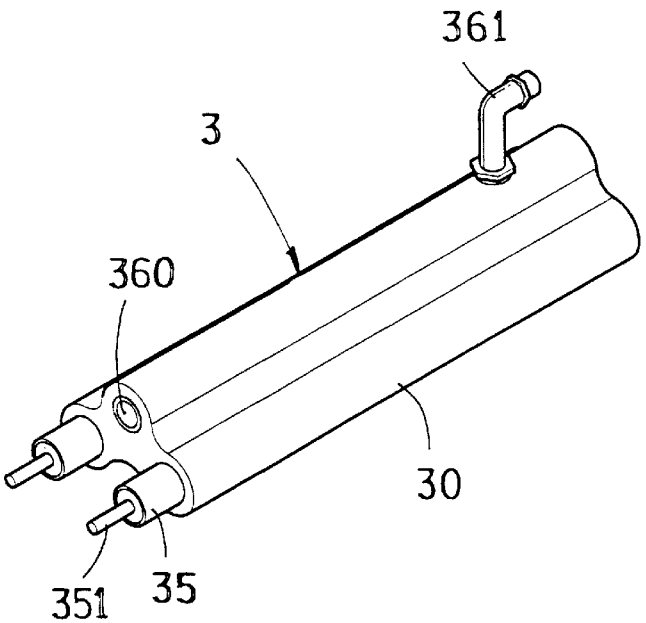
FIG. 3 is a pictorial isometric drawing of a single heat converter of the invention herein.
Figure 5:
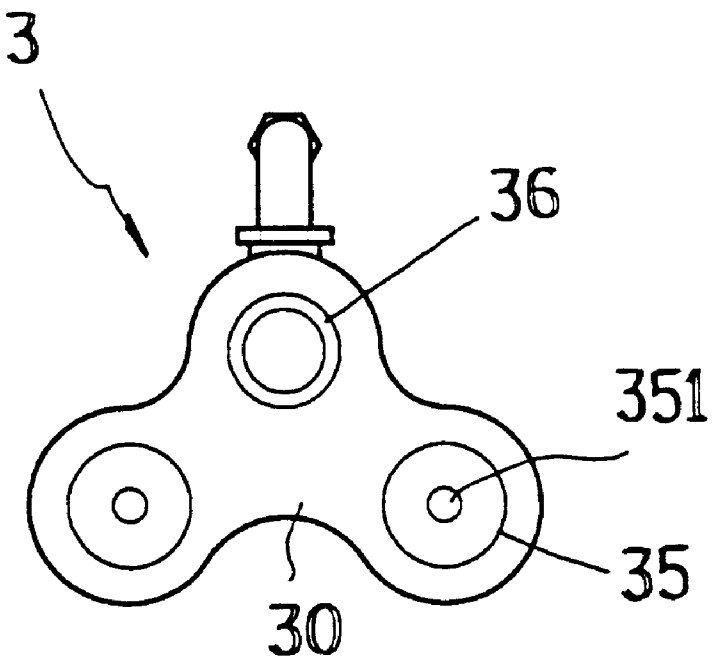
FIG. 5 is a drawing of the distal end view of the heat converter of the invention herein.

Referring to FIGS. 3 and 4, the tubular heat converter (3) of the invention herein comprises a U-shaped heating pipe (35) adjacent to flow tube (36), which may be covered by the cast body (30), as shown in FIG. 3 to form a convert module. Terminals (351) located on the front and the rear ends of the U-shaped heating pipe (35) for connecting to a power source. Referring to the water pump (31) shown in FIG. 2, the flow tube (36) conducts the water through the water entry port (360) and the steam will be discharged through the connector (361) when the water flows through the flow tube (36). Referring to FIG. 2, the connector (361) is connected to the steam conduit (32) for direct delivery of the steam. Referring to FIG. 5 of the drawing of the distal end view of the structure after being covered by the cast body (30), the flow tube (36) is mounted upwardly of the U-shaped heating pipe (35). The outer shape of the cast body (30) is formed by pressing the cast, according to the proximal configuration of the opposed positions of the heating means and the flow tube, to form a single converter and to dispose the flow tube (36) as close to the heating pipe (35) as possible to allow the generated high temperature to be transmitted to the flow tube (36).

Figure 6:
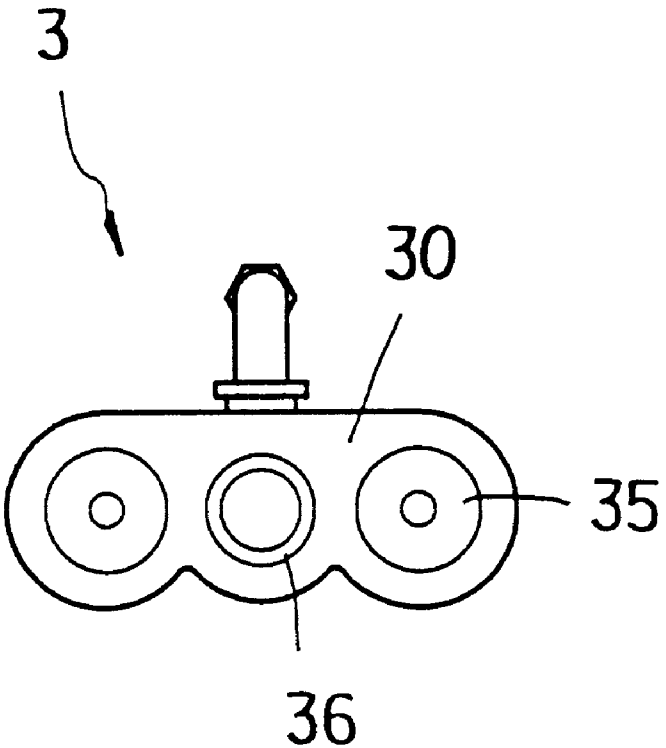
FIG. 6 is another drawing of the preferred embodiment of the invention herein.

Referring to FIG. 6, if the central U-shape slot of the heating pipe (35) is big enough for inserting in the outer diameter of the flow tube (36), then the flow tube (36) and the heating pipe (35) can be aligned in a mounting having a constant height so as to make the cast body (30) into a flat configuration for reducing the height and enhancing operation.

In summation of the foregoing section, the improved anti-explosion steam vacuum cleaner heating structure fully complies with all new patent application requirements and is here by submitted to the patent bureau for review and the granting of the commensurate patent rights.

What is claimed is:

1. A steam vacuum cleaner comprising:

a) a body portion including a handle, an on/off switch and a steam activating switch, the body portion having a suction port and a steam discharge port;

b) a water chamber located in the body portion;

c) a dust collecting chamber within the body portion and communicating with the suction port;

d) a vacuum pump assembly located within the body portion so as to draw a vacuum in the dust collecting chamber;

e) an elongated tubular heat converter including an elongated U-shaped heating pipe having spaced apart leg portions and an elongated tubular water flow tube located in alignment with a space between the spaced apart leg portions, the water flow tube including a water entry port and a steam discharge connector with a straight tubular portion located adjacent to the water entry port;

f) a water pump connected to the water chamber and the water entry port; and, g) a steam conduit connected to the steam discharge connector and the steam discharge port.

2. The steam vacuum cleaner of claim 1 wherein the straight tubular portion of the water flow tube is located in the space between the spaced apart legs of the U-shaped heating pipe.

* * * * *